US009903233B2

(12) United States Patent
Ahmed et al.

(10) Patent No.: US 9,903,233 B2
(45) Date of Patent: Feb. 27, 2018

(54) COUPLING PIN ANTI-ROTATION FOR A SWITCHABLE ROLLER FINGER FOLLOWER

(71) Applicant: Schaeffler Technologies AG & Co. KG, Herzogenaurach (DE)

(72) Inventors: Faheem Ahmed, Troy, MI (US); Colin Foster, Belle River (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 67 days.

(21) Appl. No.: 15/215,647

(22) Filed: Jul. 21, 2016

(65) Prior Publication Data

US 2018/0023425 A1 Jan. 25, 2018

(51) Int. Cl.

| | |
|---|---|
| ***F01L 1/18*** | (2006.01) |
| ***F01L 1/20*** | (2006.01) |
| *F01L 1/46* | (2006.01) |
| *F01L 13/00* | (2006.01) |

(52) U.S. Cl.

CPC ..... *F01L 1/205* (2013.01); *F01L 1/18* (2013.01); *F01L 1/46* (2013.01); *F01L 13/0005* (2013.01); *F01L 2001/186* (2013.01); *F01L 2001/187* (2013.01); *F01L 2001/467* (2013.01)

(58) Field of Classification Search

CPC . F01L 2001/186; F01L 2001/187; F01L 1/46; F01L 2001/467; F01L 13/0005

USPC ..... 123/90.16, 90.39, 90.44

See application file for complete search history.

(56) References Cited

U.S. PATENT DOCUMENTS

| | | | | |
|---|---|---|---|---|
| 4,611,558 | A * | 9/1986 | Yoshizaki | F01L 13/0005 123/198 F |
| 7,673,601 | B2 | 3/2010 | Spath et al. | |
| 2008/0149059 | A1* | 6/2008 | Murphy | F01L 1/18 123/90.39 |
| 2011/0226208 | A1 | 9/2011 | Zurface et al. | |

* cited by examiner

*Primary Examiner* — Jorge Leon, Jr.

(74) *Attorney, Agent, or Firm* — Matthew V. Evans

(57) ABSTRACT

A coupling pin anti-rotation arrangement is provided for a switchable roller finger follower within a valve train of an internal combustion engine capable of switching between at least two valve lift modes. The switchable roller finger follower includes an inner lever, an outer lever, a coupling pin, and an anti-rotation clip. The coupling pin, located on one of the inner or outer levers, has a first locking surface, and a first, and preferably, second coupling pin-side anti-rotation flat. The coupling pin moves longitudinally within a coupling pin bore to a first, locked position and a second, unlocked position. The anti-rotation clip has a first and, preferably, second clip-side finger to slidably guide the first and second coupling pin-side anti-rotation flats to ensure alignment of the first locking surface with a second locking surface, located on the other of the inner lever or the outer lever, during all modes of operation.

20 Claims, 7 Drawing Sheets

COUPLING PIN ANTI-ROTATION FOR A SWITCHABLE ROLLER FINGER FOLLOWER

BACKGROUND

The present disclosure relates to a switchable roller finger follower for a valve train of an internal combustion (IC) engine, and more particularly, to the coupling pin of a switchable roller finger follower (SRFF) that provides at least two discrete valve lift modes.

More stringent fuel economy regulations in the transportation industry have prompted the need for improved efficiency of the IC engine. Light-weighting, friction reduction, thermal management, variable valve timing and a diverse array of variable valve lift technologies are all part of the technology toolbox for IC engine designers.

Variable valve lift (VVL) systems typically employ a technology in a valve train of an IC engine that allows different engine valve lifts to occur. The valve train is formed of the components that are required to actuate an engine valve, including a camshaft (also termed "cam"), the valve, and all components that lie in between. VVL systems are typically divided into two categories: continuous variable and discrete variable. Continuous variable valve lift systems are capable of varying a valve lift from a design lift minimum to a design lift maximum to achieve any of several lift heights. Discrete variable valve lift systems are capable of switching between two or more distinct valve lifts. Components that enable these different valve lift modes are often called switchable valve train components. Typical two-step discrete valve lift systems switch between a full valve lift mode and a partial valve lift mode, often termed cam profile switching, or between a full valve lift mode and a no valve lift mode that facilitates deactivation of the valve. Three-step discrete valve lift systems can combine valve deactivation and cam profile switching strategies. Valve deactivation can be applied in different ways. In the case of a four-valve-per-cylinder configuration (two intake+two exhaust), one of two intake valves can be deactivated. Deactivating only one of the two intake valves can provide for an increased swirl condition that enhances combustion of the air-fuel mixture. In another scenario, all of the intake and exhaust valves are deactivated for a selected cylinder which facilitates cylinder deactivation. On most engines, cylinder deactivation is applied to a fixed set of cylinders, when lightly loaded at steady-state speeds, to achieve the fuel economy of a smaller displacement engine. A lightly loaded engine running with a reduced amount of active cylinders requires a higher intake manifold pressure, and, thus, a greater throttle plate opening, than an engine running with all of its cylinders in the active state. Given the lower intake restriction, throttling losses are reduced in the cylinder deactivation mode and the engine runs with greater efficiency. For those engines that deactivate half of the cylinders, it is typical in the engine industry to deactivate every other cylinder in the firing order to ensure smoothness of engine operation while in this mode. Deactivation also includes shutting off the fuel to the dormant cylinders. Reactivation of dormant cylinders occurs when the driver demands more power for acceleration. The smooth transition between normal and partial engine operation is achieved by controlling ignition timing, cam timing and throttle position, as managed by the engine control unit (ECU). Examples of switchable valve train components that serve as cylinder deactivation facilitators include roller finger followers, roller lifters, pivot elements, rocker arms and camshafts; each of these components is able to switch from a full valve lift mode to a no valve lift mode. The switching of lifts occurs on the base circle or non-lift portion of the camshaft; therefore the time to switch from one mode to another is limited by the time that the camshaft is rotating through its base circle portion; more time for switching is available at lower engine speeds and less time is available at higher engine speeds. Maximum switching engine speeds are defined by whether there is enough time available on the base circle portion to fully actuate a coupling assembly to achieve the desired lift mode.

In today's IC engines, many of the switchable valve train components that enable valve deactivation for cylinder deactivation contain a coupling or locking assembly that is actuated by an electro-hydraulic system. The electro-hydraulic system typically contains at least one solenoid valve within an array of oil galleries that manages engine oil pressure to either lock or unlock the coupling assembly within the switchable valve train component to enable a valve lift switching event. These types of electro-hydraulic systems require time within the combustion cycle to actuate the switchable valve train component.

In most IC engine applications, switchable valve train components for cylinder deactivation in an electro-hydraulic system are classified as "pressure-less-locked", which equates to:

a). In a no or low oil pressure condition, the spring-biased coupling assembly will be in a locked position, facilitating the function of a standard valve train component that translates rotary camshaft motion to linear valve motion; and, b). In a condition in which engine oil pressure is delivered to the coupling assembly that exceeds the force of the coupling assembly bias spring, the coupling assembly will be displaced by a given stroke to an unlocked position, facilitating valve deactivation where the rotary camshaft motion is not translated to the valve.

"Pressure-less-unlocked" electro-hydraulic systems can be found in some cam profile switching systems that switch between a full or high valve lift and a partial or low valve lift, which equates to:

a). In a no or low oil pressure condition, the spring-biased coupling assembly will be in an unlocked position, facilitating a partial valve lift event; and, b). In a condition in which engine oil pressure is delivered to the coupling assembly that exceeds the force of the coupling assembly bias spring, the coupling assembly will be displaced a given stroke to a locked position, facilitating a full valve lift event.

Vital to the durability and performance of a switchable valve train component is the robustness of the coupling assembly. Two important design attributes of the coupling assembly include: 1). the ability to switch from a locked to an unlocked position very quickly, and 2). a high resistance to wear. However, many times these attributes are in opposition. For example, the locking/unlocking stroke of the coupling assembly to engage/disengage an adjacent component has a direct impact on switching times; a shorter stroke for a given cross-sectional area of a coupling assembly will likely yield a faster switching time. Yet, a shorter stroke typically dictates a smaller contact area with the engaged or disengaged component, meaning that a given load is applied over a smaller area leading to higher contact pressures and subsequent wear. For this reason, various coupling assembly forms, materials, coatings and heat treatments are often employed in an effort to maximize wear resistance in order to minimize the actuation stroke and resultant contact area.

Many coupling assembly designs utilize a coupling pin that is configured with a locking surface that engages or disengages another locking surface to enable different valve lift modes. In the case of the SRFF, the coupling pin moves longitudinally within a bore of one lever to engage or disengage another lever. In many instances the coupling pin contains a flat locking surface that engages a corresponding flat locking surface. Flat locking surfaces are used because of their increased contact area and thus lower stresses and resultant wear, as compared to other shaped interfaces. However, alignment of the flat locking surface of the locking pin with the corresponding flat locking surface is required to enable locking functionality. Therefore, a solution is needed to provide alignment or anti-rotation of the locking pin, such that its flat locking surface maintains alignment with a corresponding flat locking surface. Additionally, a solution is needed that can be applied to different known SRFF designs that facilitate valve deactivation, cam profile switching, or a combination of the two, with a compact arrangement.

SUMMARY

A coupling pin anti-rotation arrangement for multiple embodiments of a SRFF, capable of switching between two or more valve lift modes of operation, is provided. In a first example embodiment, the SRFF is capable of switching between a full valve lift mode and a no valve lift mode. In a second example embodiment, the SRFF is capable of switching between a full or high valve lift mode and a partial or low valve lift mode. Both embodiments comprise of an outer lever that has two arms that extend along longitudinal sides of an inner lever. The inner lever has a cavity in the center to house a roller, mounted by a transverse axle, which serves as a camshaft interface. The inner and outer levers are pivotably connected at one end, and lockably connected at an opposite end. When the inner lever is locked to the outer lever via a coupling pin located on one of the inner or outer levers, a first locked position is achieved, defining a first valve lift mode. When the coupling pin is longitudinally actuated within a coupling pin bore such that the inner lever is unlocked from the outer lever, a second unlocked position is achieved, defining a second valve lift mode. During the second valve lift mode, at least one lost motion resilient element or spring provides a force that acts upon one of the inner or outer lever during its arcuate movement relative to the other lever. The coupling pin has a longitudinal coupling projection with a first locking surface in the form of a flat, located on the other of the inner or outer levers, to engage a second locking surface in the form of a flat upon actuation of the coupling pin within the coupling pin bore. To facilitate alignment of the first and second locking surfaces, a first coupling pin-side anti-rotation flat is arranged on the longitudinal coupling projection of the coupling pin. An anti-rotation clip, arranged on the same lever as the coupling pin bore, has a first clip-side finger at a locking end. The first coupling pin-side anti-rotation flat is slidably guided by the first clip-side finger throughout its longitudinal movement within the coupling pin bore to ensure proper alignment of the first and second locking surfaces. A second clip-side finger can be arranged at the locking end of the anti-rotation clip to slidably guide a second coupling pin-side anti-rotation flat arranged on the longitudinal coupling projection of the coupling pin. The first and second clip-side fingers can be configured with guide surfaces that face one another and guide oppositely located first and second coupling pin-side anti-rotation flats. At least one attachment hook can be arranged on the anti-rotation clip at an end opposite the clip-side fingers. The at least one attachment hook can be engaged with an end of a coupling pin bore housing opposite a locking end to retain the anti-rotation clip. The first, second, or both clip-side fingers can also retain the anti-rotation clip, engaging with the locking end of the coupling pin bore housing. With the previously described retention features of the anti-rotation clip, easy installation and removal from the coupling pin bore housing is possible and can be further enhanced by use of an elastically deflectable material for the anti-rotation clip. Various locations of the coupling pin bore and anti-rotation clip will now be described for the first and second example embodiments.

The first example embodiment of the SRFF that applies the disclosed arrangement for coupling pin anti-rotation comprises an outer lever that includes the coupling pin bore and the anti-rotation clip. In a first, locked position, the first locking surface of the coupling pin is engaged with the second locking surface of the inner lever. In this first, locked position, the inner lever and outer lever rotate in unison about a hydraulic pivot element, resulting in a full valve lift mode. In a second, unlocked position, the first locking surface is disengaged with the second locking surface of the inner lever. In this second, unlocked position, the inner lever rotates independently of the outer lever, resulting in a no valve lift mode. The SRFF captured in the first embodiment is typically utilized to facilitate engine valve deactivation.

The second example embodiment of the SRFF that applies the disclosed arrangement for coupling pin anti-rotation comprises an inner lever that houses the coupling pin bore and the anti-rotation clip. In this example embodiment, the outer lever comprises at least one slider pad or roller to interface with at least one camshaft lobe. In a first, locked position, the first locking surface of the coupling pin is engaged with the second locking surface of the outer lever, resulting in a first valve lift mode. In a second, unlocked position, the first locking surface is disengaged with the second locking surface of the outer lever, resulting in a second valve lift mode. Both the first and second valve lift modes typically achieve different valve lifts that are greater than zero. The SRFF captured in the second example embodiment is typically utilized to facilitate cam profile switching.

Additional aspects of the disclosure that can be used alone or in various combinations are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE EXAMPLE EMBODIMENTS

Figure 1:
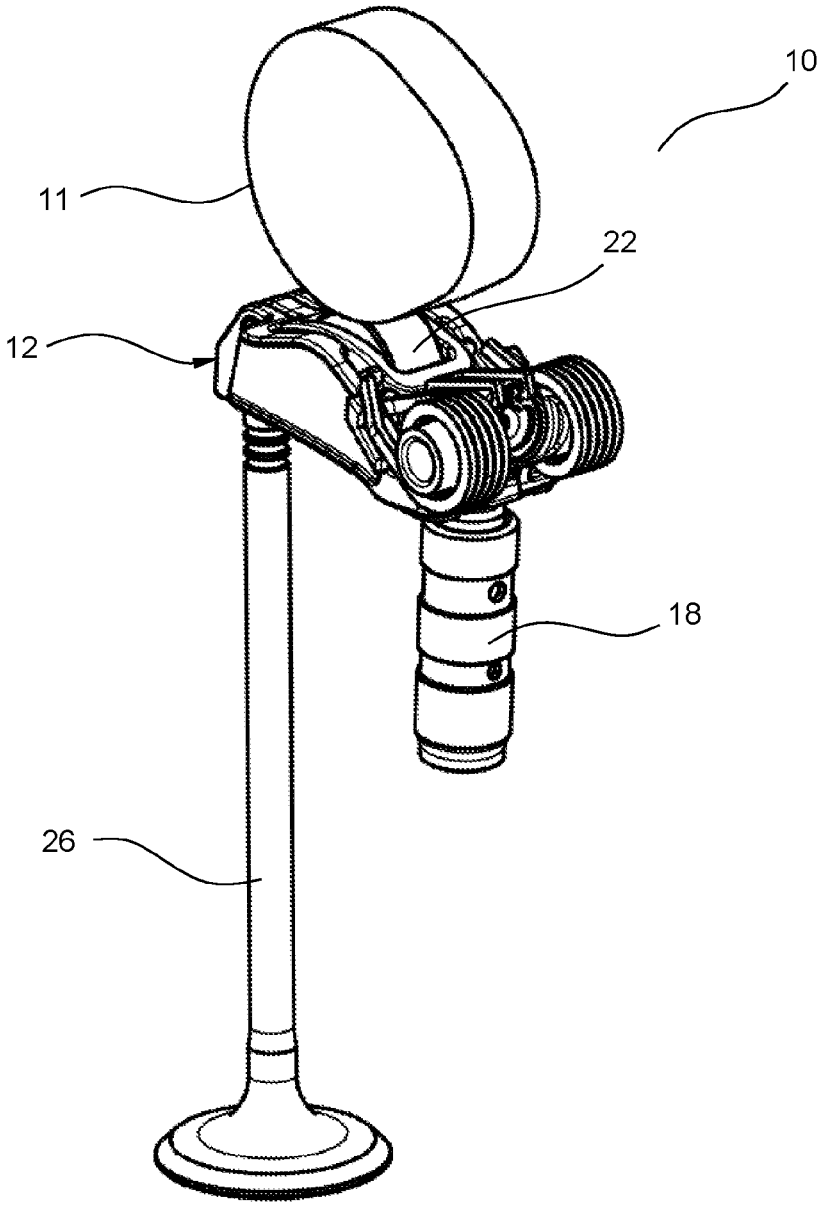
FIG. 1 is a perspective view of a valve train system that includes a SRFF according to a first example embodiment of the disclosure with no valve lift and full valve modes of operation.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

Referring to FIG. 1, a perspective view of a SRFF 12 is shown within a valve train system 10 of an IC engine that includes a camshaft 11, an engine valve 26 and a hydraulic pivot element 18. The camshaft 11 rotationally actuates the SRFF 12 through a roller 22 interface about the hydraulic pivot element 18, causing rotational lift provided by the camshaft 11 to be translated to linear valve lift. The SRFF 12 shown in FIG. 1 captures a first example embodiment of a coupling pin anti-rotation arrangement, which will be described in detail with reference to FIGS. 2A through 7B.

Figure 2A:
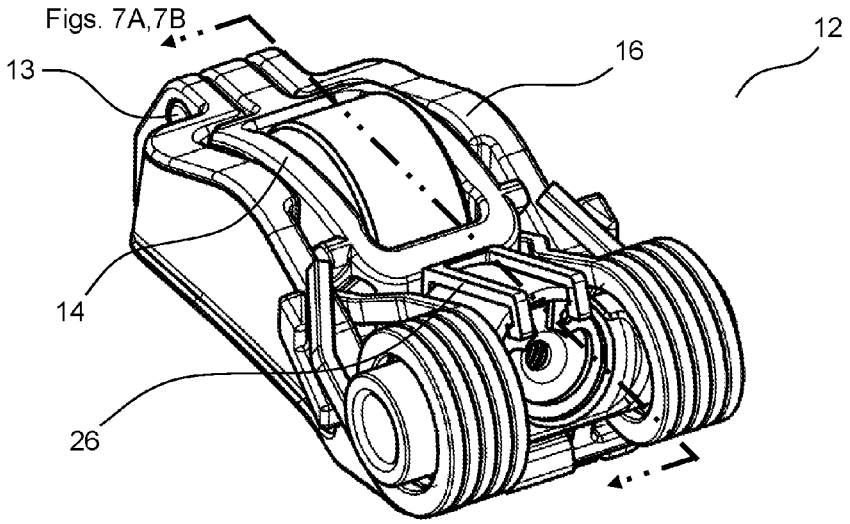
FIGS. 2A and 2B are perspective views of the SRFF of FIG. 1.
Figure 2B:
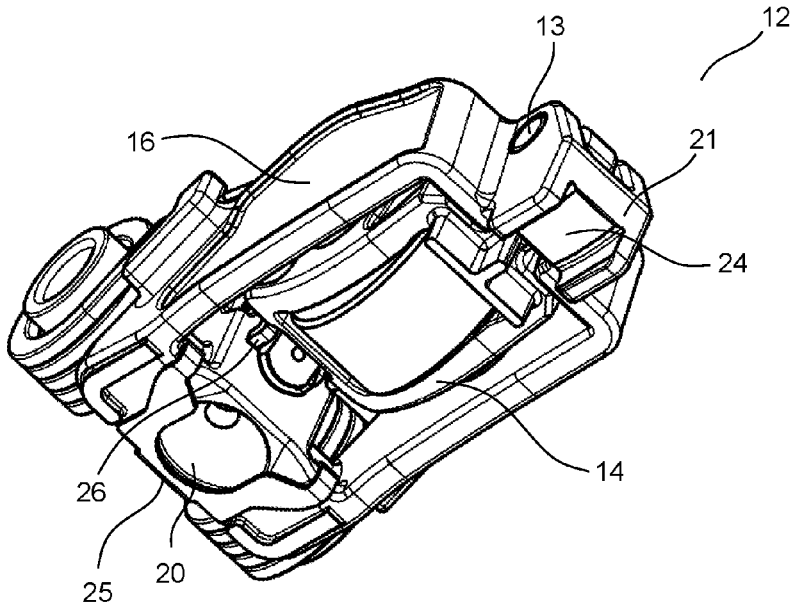

FIGS. 2A and 2B show top-side and bottom-side perspective views of the SRFF 12, respectively. The SRFF 12 is comprised of an outer lever 16 attached to an inner lever 14 by a pivot axle 13. The outer lever 16 is configured with a valve interface 24 at a third end 21 and a hydraulic pivot element interface 20 at a fourth end 25.

Referring now to FIGS. 3A to 7B, a detailed explanation of the design and function now follows for the SRFF 12 captured in FIGS. 1 through 2B. With specific reference to FIGS. 3A through 4B, the inner lever 14 is configured with a first pivot aperture 64 on a first end 34 and the outer lever 16 is configured with second and third pivot apertures 15A,15B on the third end 21. The pivot axle 13 shown in FIGS. 2A and 2B is disposed within the first, second, and third pivot apertures 64,15A,15B to pivotably connect the inner lever 14 to the outer lever 16. The outer lever 16 has two outer arms 50A,50B that extend along longitudinal sides 68A,68B of the inner lever 14. A cavity 61 within the inner lever 14 houses the roller 22 that interfaces with the camshaft 11 shown in FIG. 1. The roller 22 is connected to the inner lever 14 via a transverse axle pin 60 disposed within two axle apertures 70A,70B of the inner lever 14. Lost motion resilient elements or springs 54A,54B are arranged on respective lost motion spring posts 52A,52B of the outer lever 16. Lost motion spring retainers 56A,56B ensure containment of the lost motion springs 54A,54B on their respective lost motion spring posts 52A,52B during operation. The lost motion springs 54A,54B are arranged to apply an upward force against lost motion spring landings 58A, 58B located on the inner lever 14 to bias the roller 22 of the inner lever 14 to an upper-most position.

Figure 3A:
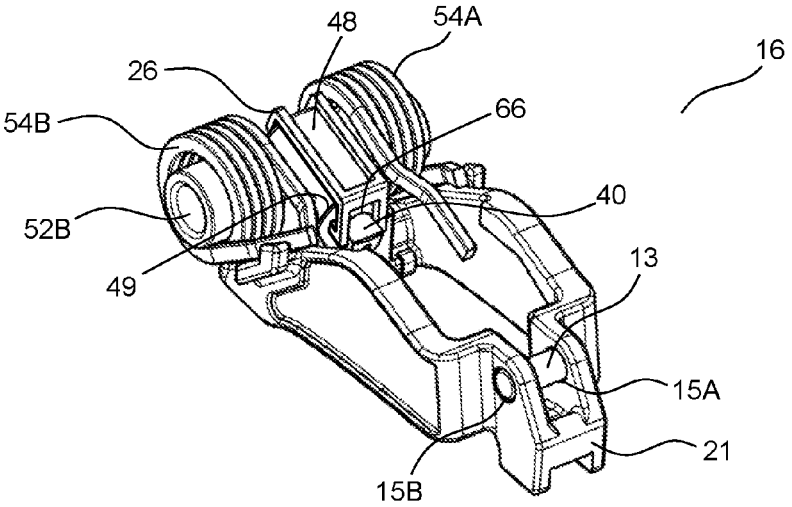
FIGS. 3A and 3B are perspective views of the outer lever of the SRFF of FIGS. 2A and 2B.
Figure 3B:
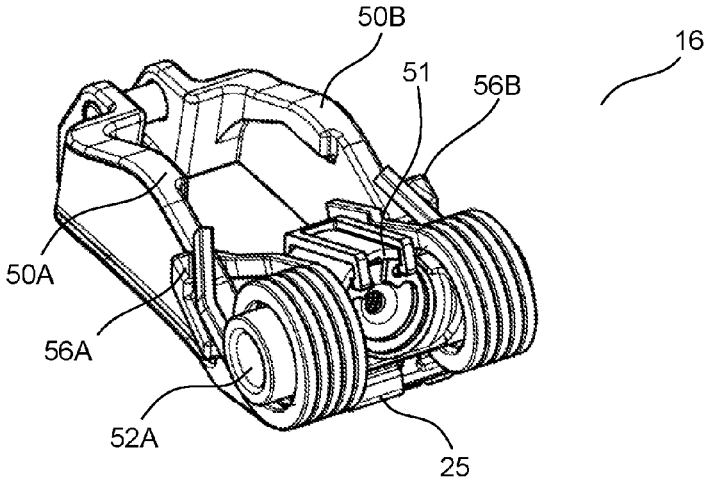
Figure 4A:
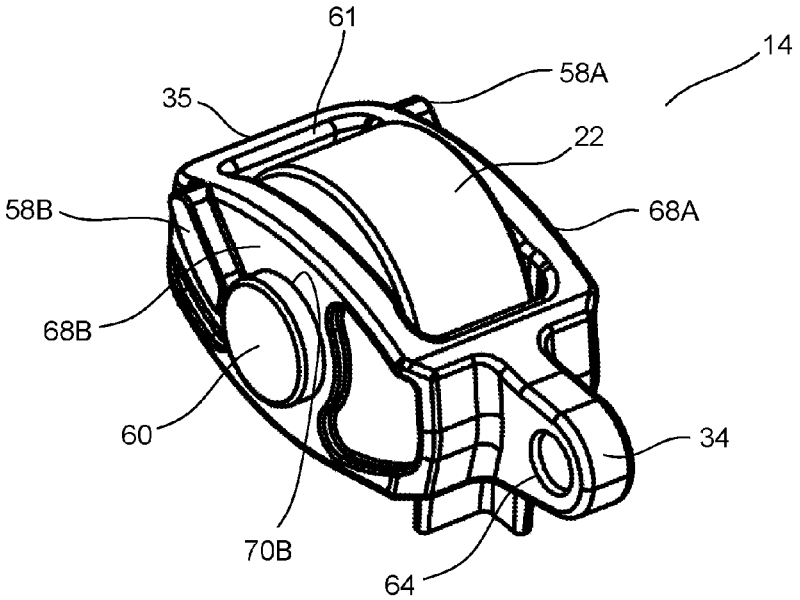
FIGS. 4A and 4B are perspective views of the inner lever of the SRFF of FIGS. 2A and 2B.
Figure 4B:
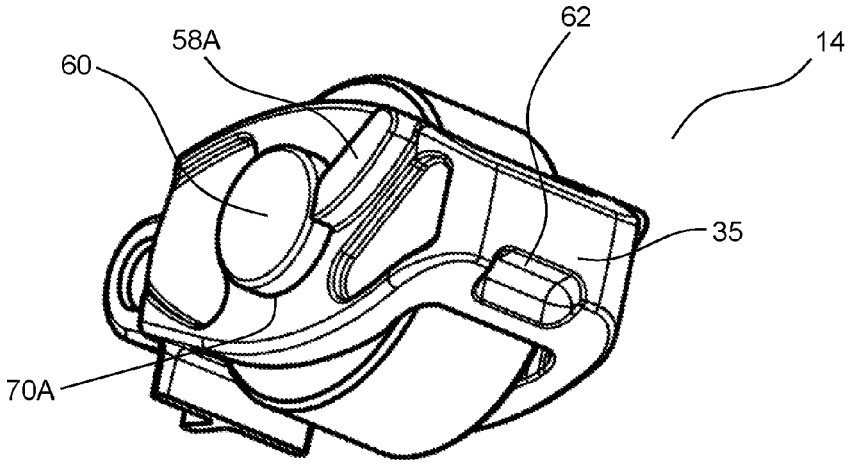
Figure 5:
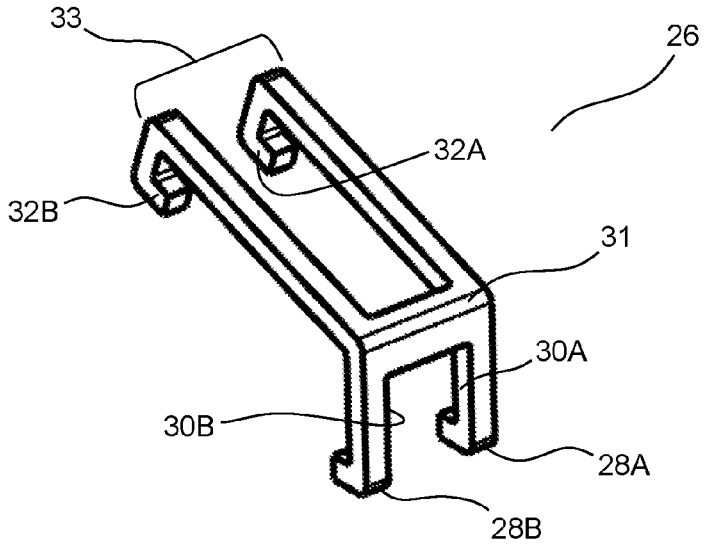
FIG. 5 is a perspective view of an anti-rotation clip utilized in FIGS. 2A through 3B.

With reference to FIGS. 3A and 3B, a fourth end 25 of the outer lever 16 is configured with a coupling pin bore 66 that houses a coupling pin 40. Now referencing FIG. 6, the coupling pin 40 is shown that is configured with a coupling projection 42. The preferred material of the coupling pin 40 is steel, but other suitable materials are also possible. A first locking surface 44 is configured on the coupling projection 42 as a flat but can be of any suitable form for such a locking function. Adjacent to the first locking surface 44 is a first coupling pin-side anti-rotation flat 46A. A second coupling pin-side anti-rotation flat 46B can also be arranged opposite of the first coupling pin-side anti-rotation flat 46A. With reference to FIG. 4B, a second locking surface 62 is shown on the second end 35 of the inner lever 14, which receives the first locking surface 44 of the coupling projection 42 of the coupling pin 40. The second locking surface 62 is also formed as a flat but can be of any suitable form for such a locking function.

Figure 7A:
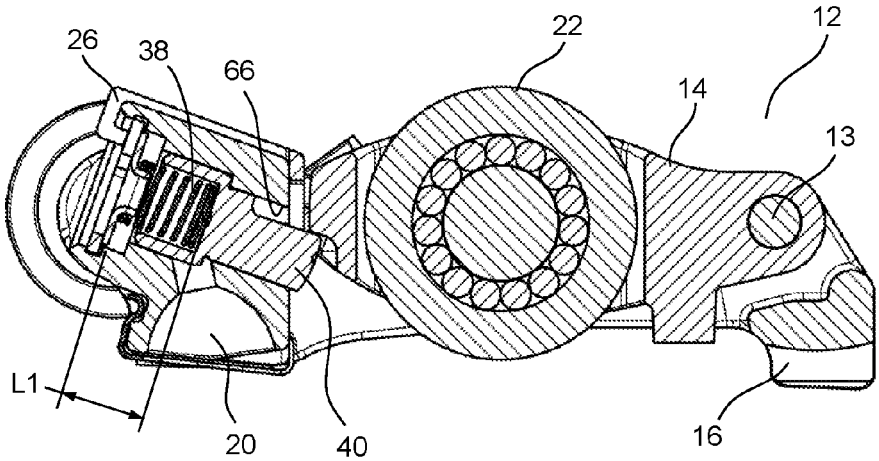
FIG. 7A is a cross-sectional view of the SRFF of FIGS. 2A and 2B in a first, locked position.

With reference to FIG. 7A, the coupling pin 40 is shown in a first, locked position in which a coupling pin bias spring 38 is at a first compressed length L1. In this first, locked position, the inner lever 14 and the outer lever 16 pivot in unison about the hydraulic pivot element 18 (reference FIG. 1), resulting in a full valve lift mode.

Figure 7B:
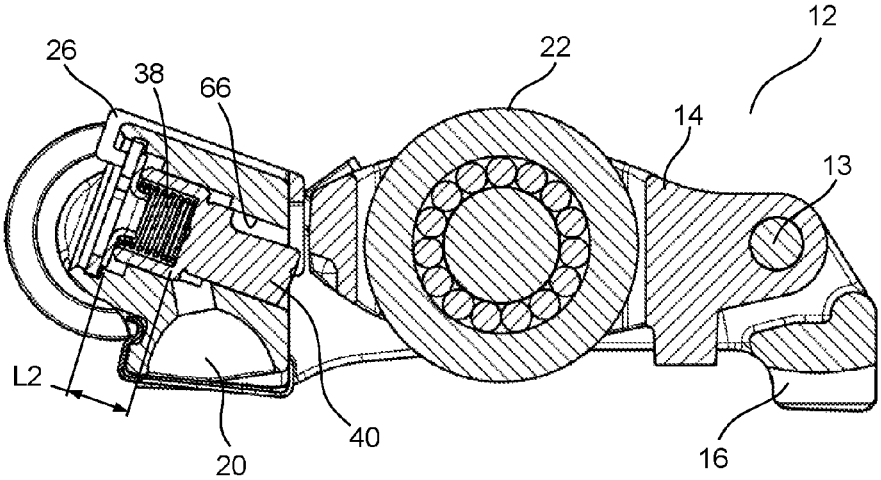
FIG. 7B is a cross-sectional view of the SRFF of FIGS. 2A and 2B in a second, unlocked position.

Now referencing FIG. 7B, the coupling pin 40 is longitudinally displaced within the coupling pin bore 66, defining a second, unlocked position in which the coupling bias spring 38 is at a second compressed length L2. The second compressed length L2 of the second, unlocked position is less than the first compressed length L1 of the first, locked position. In this second, unlocked position, the inner lever 14 is allowed to rotate about the pivot axle 13 during each camshaft rotation, resulting in an arcuate motion of the inner lever 14, often termed lost motion or lost motion stroke, while the outer lever 16 remains stationary.

During the lost motion stroke it is necessary to prevent excessive rotation of the coupling pin 40 to ensure that the first locking surface 44 remains aligned with the second locking surface 62 of the inner lever 14. If this does not occur, the coupling pin 40 will not be displaceable to the first, locked position, as only a small space or gap is present between the first and second locking surfaces 44,62. While this space can be of any size, it is preferably in the range of 0.010 to 0.300 mm. Referring to FIGS. 3A, 3B, 5 and 6, in accordance with such an anti-rotation requirement of the coupling pin 40, an anti-rotation clip 26 is arranged on the outer lever 16. The anti-rotation clip 26 is configured with a first clip-side finger 28A at a locking end 31 of the anti-rotation clip 26. The first clip-side finger 28A has a first guide surface 30A that slidably guides a first coupling pin-side anti-rotation flat 46A arranged on a longitudinal coupling projection 42 of the coupling pin 40. A second clip-side finger 28B having a second guide surface 30B that faces the first guide surface 30A can also be arranged at the locking end 31 of the anti-rotation clip 26 to slidably guide the second coupling pin-side anti-rotation flat 46B. The first or second clip-side fingers 28A,28B can engage with a locking end 49 of a coupling pin bore housing 48 to secure or retain the anti-rotation clip 26 to the outer lever 16. To ensure that proper alignment of the first and second locking surfaces 44,62 is fulfilled, a small space or gap is present between the coupling pin-side anti-rotation flats 46A,46B and the first and second guide surfaces 30A,30B of the first and second clip-side fingers 28A,28B. While this space can be of any size, it is preferably in the range of 0.010 to 0.500 mm. This space ensures a free, non-binding movement between the coupling pin 40 and first and second clip-side fingers 28A,28B under all operating and size conditions, however, any rotation of the locking pin 40 will be limited by this space. For this reason, contact between either the first or second guide surface 30A,30B and the respective coupling pin-side anti-rotation flats 46A,46B may occur over a portion or the entirety of the coupling pin stroke, inclusive of the first, locked and second, unlocked coupling pin 40 positions. To further retain or secure the anti-rotation clip 26 to the outer lever 16, a first attachment hook 32A can be arranged on an end 33 of the anti-rotation clip 26 that is opposite to the first and second clip-side fingers 28A,28B. The first attachment hook 32A can engage with an end 51 of the coupling pin bore housing 48 that is opposite the locking end 49. A second attachment hook 32B (or more, if needed) can also provide further retention of the anti-rotation clip 26. Given the previously described retention features of the anti-rotation clip 26, easy installation and removal from the coupling pin bore housing 48 is possible and can be further enhanced by use of an elastically deflectable material for the anti-rotation clip 26.

Figure 6:
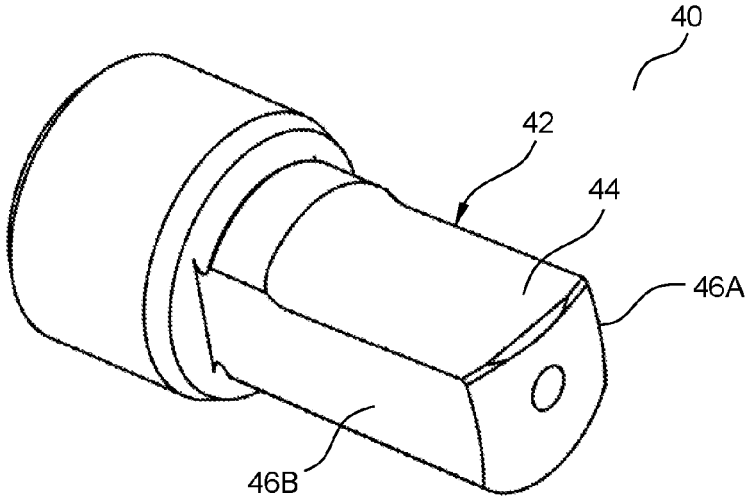
FIG. 6 is a perspective view of a coupling pin contained within the SRFF of FIGS. 2A, 2B, and 8.
Figure 8:
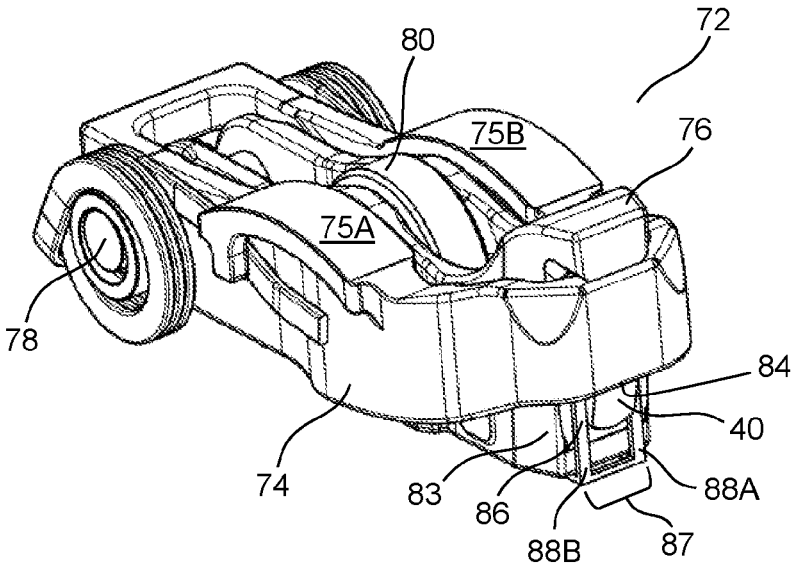
FIG. 8 is a perspective view of a SRFF according to a second example embodiment of the disclosure with high valve lift and low valve lift modes of operation.
Figure 9:
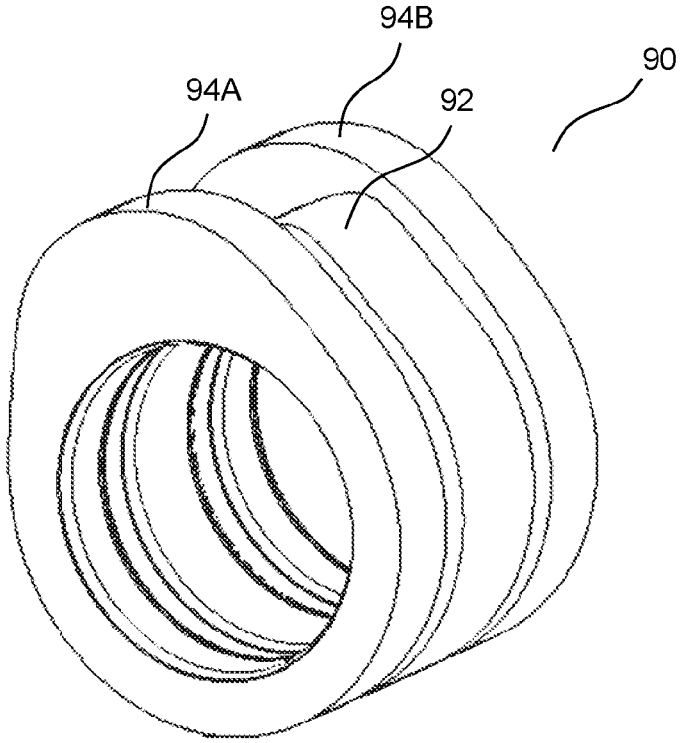
FIG. 9 is a perspective view of a tri-lobe camshaft for the SRFF shown in FIG. 8.

Referring now to FIG. 8, a SRFF 72 is shown that captures a second embodiment of a coupling pin anti-rotation arrangement. The SRFF 72 includes an outer lever 74 pivotably attached to an inner lever 76 via pivot shaft 78. The inner lever 76 is configured with a roller 80 to interface with a first low-lift camshaft lobe 92 of a tri-lobe camshaft configuration 90 shown in FIG. 9. The outer lever 74 is configured with two high lift slider pads 75A,75B that interface with second and third high-lift camshaft lobes 94A,94B of the tri-lobe camshaft configuration 90. The inner lever 76 is configured with a coupling pin bore (not shown) that houses the coupling pin 40 of the first example embodiment with the first locking surface 44 and adjacent coupling-side anti-rotation flats 46A,46B, as shown in FIG. 6. An anti-rotation clip 86 is arranged on the coupling pin bore housing 83. The coupling pin 40 moves longitudinally within the coupling pin bore of the inner lever 76 to engage and disengage a second locking surface 84 located on the outer lever 74. Engagement of the first locking surface 44 of the coupling pin 40 with the second locking surface 84 of the outer lever 74 defines a first, locked position that corresponds with a first valve lift mode. Disengagement of the first locking surface 44 of the coupling pin 40 from the second locking surface 84 of the outer lever 74 defines a second, unlocked position that corresponds with a second valve lift mode. Typically the first valve lift mode is greater than the second valve lift mode, therefore, the first valve lift mode is often termed "full lift" or "high lift" and the second valve lift mode is often termed "low lift" or "partial lift." While in either of the first or second valve lift modes, anti-rotation of the coupling pin 40 is achieved by one or both of the coupling pin-side anti-rotation flats 46A,46B (reference FIG. 6) being slidably guided by one or both clip-side fingers 88A,88B arranged on a locking end 87 of the anti-rotation clip 86.

The second example embodiment of this disclosure shown in FIG. 8, depicts a SRFF with two high lift slider interfaces 75A,75B on the outer lever 74 and a low lift interface on the inner lever 76 in the form of the roller 80. It would also be possible to have the high lift interface on the inner lever 76 in the form of a single interface and the low lift interface on the outer lever 74, in the form of two interfaces.

Having thus described various embodiments of the present arrangement in detail, it is to be appreciated and will be apparent to those skilled in the art that many physical changes, only a few of which are exemplified in the detailed description above, could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A switchable roller finger follower comprising:

an inner lever having first and second ends;

an outer lever having:

two outer arms that extend along longitudinal sides of the inner lever; and, a third end mounted for pivoting movement at the first end of the inner lever by a pivot axle;

a coupling pin arranged to move longitudinally within a coupling pin bore located on one of the inner lever or the outer lever on an end opposite from the pivot axle, the coupling pin having:

a coupling projection with a first locking surface; and, a first coupling pin-side anti-rotation flat; and, an anti-rotation clip arranged on a same one of the inner lever or the outer lever as the coupling pin bore, the anti-rotation clip having a first clip-side finger at a locking end; and, the coupling pin is moveable from a first, locked position with the first locking surface engaged with a second locking surface located on the other of the inner lever or the outer lever, to a second, unlocked position where the first locking surface is not engaged with the second locking surface, and the first coupling pin-side anti-rotation flat is slidably guided by the first clip-side finger.

2. The switchable roller finger follower of claim 1, wherein the first coupling pin-side anti-rotation flat is guided by a guide surface of the first clip-side finger.

3. The switchable roller finger follower of claim 1, further comprising a second clip-side finger on the anti-rotation clip and a second coupling pin-side anti-rotation flat on the coupling pin, the second coupling-pin side anti-rotation flat being slidably guided by the second clip-side finger as the coupling pin moves between the first and second positions.

4. The switchable roller finger follower of claim 3, wherein the first and second clip-side fingers are configured with guide surfaces that face one another and guide oppositely located first and second coupling pin-side anti-rotation flats.

5. The switchable roller finger follower of claim 1, wherein the first and second locking surfaces have a space defined therebetween that ranges from 0.001 to 0.300 mm.

6. The switchable roller finger follower of claim 1, wherein the first clip-side finger is engaged with a locking end of a coupling pin bore housing.

7. The switchable roller finger follower of claim 1, wherein the anti-rotation clip has at least one attachment hook at an end opposite the first clip-side finger.

8. The switchable roller finger follower of claim 7, wherein the at least one attachment hook is engaged with an end of a coupling pin bore housing opposite a locking end.

9. The switchable roller finger follower of claim 8, wherein the anti-rotation clip is elastically deflectable for engagement with the coupling pin bore housing.

10. The switchable roller finger follower of claim 1, wherein the first and second locking surfaces are formed as flats.

11. The switchable roller finger follower of claim 1, wherein the first coupling pin-side anti-rotation flat is slidably guided by the first clip-side finger in the first, locked and the second, unlocked positions.

12. The switchable roller finger follower of claim 1, wherein the first clip-side finger remains in constant contact with the first coupling pin-side anti-rotation flat.

13. The switchable roller finger follower of claim 1, wherein the first, locked position defines a first valve lift mode and the second, unlocked position defines a second valve lift mode.

14. The switchable roller finger follower of claim 13, wherein the first valve lift mode is a full valve lift mode and the second valve lift mode is a no valve lift mode.

15. The switchable roller finger follower of claim 14, wherein the second locking surface is located on the inner lever and the coupling pin bore and anti-rotation clip are located on the outer lever.

16. The switchable roller finger follower of claim 13, wherein the first valve lift mode is a high valve lift mode and the second valve lift mode is a low valve lift mode.

17. The switchable roller finger follower of claim 16, wherein the second locking surface is located on the outer lever and the coupling pin bore and anti-rotation clip are located on the inner lever.

18. The switchable roller finger follower of claim 1, further comprising a valve interface configured on the third end and a pivot interface configured on a fourth end of the outer lever.

19. The switchable roller finger follower of claim 1, further comprising a spring in contact with the coupling pin, the spring having a first compressed length in the first locked position and a second compressed length in the second unlocked position, wherein the first compressed length is greater than the second compressed length.

20. The switchable roller finger follower of claim 1, further comprising at least one lost motion spring arranged between the inner lever and the outer lever.

* * * * *